US009232852B2

(12) United States Patent
Pfenniger et al.

(10) Patent No.: US 9,232,852 B2
(45) Date of Patent: Jan. 12, 2016

(54) TOOTHBRUSH AND PROCESS FOR PRODUCING THE SAME

(71) Applicant: TRISA HOLDING AG, Triengen (CH)

(72) Inventors: Philipp Pfenniger, Triengen (CH); Franz Fischer, Triengen (CH)

(73) Assignee: TRISA HOLDING AG, Triengen (CH)

( * ) Notice: Subject to any disclaimer, the term of this patent is extended or adjusted under 35 U.S.C. 154(b) by 140 days.

(21) Appl. No.: 14/083,896

(22) Filed: Nov. 19, 2013

(65) Prior Publication Data

US 2014/0075696 A1 Mar. 20, 2014

Related U.S. Application Data

(60) Continuation of application No. 13/765,151, filed on Feb. 12, 2013, now Pat. No. 8,613,123, which is a continuation of application No. 13/067,844, filed on Jun. 29, 2011, now Pat. No. 8,418,306, which is a (Continued)

(30) Foreign Application Priority Data

Dec. 19, 2002 (DE) ..... 102 59 723

(51) Int. Cl.

| | |
|---|---|
| ***A46B 9/04*** | (2006.01) |
| ***A46B 3/06*** | (2006.01) |
| ***A46B 5/00*** | (2006.01) |
| ***A46B 9/02*** | (2006.01) |
| ***A46D 3/04*** | (2006.01) |
| *A46B 3/20* | (2006.01) |

(Continued)

(52) U.S. Cl.

CPC ... *A46B 9/04* (2013.01); *A46B 3/06* (2013.01); *A46B 5/0029* (2013.01); *A46B 9/026* (2013.01); *A46B 15/0032* (2013.01); *A46D 3/045* (2013.01); *A46B 3/20* (2013.01); *A46B 7/06* (2013.01); *A46B 15/0002* (2013.01); *A46B 2200/1066* (2013.01)

(58) Field of Classification Search

CPC ..... A46B 2200/1066; A46B 5/0029; A46B 7/06; A46B 3/00; A46B 7/00

See application file for complete search history.

(56) References Cited

U.S. PATENT DOCUMENTS

| | | | |
|---|---|---|---|
| 2,298,156 | A | 10/1942 | Person |
| 2,706,825 | A | 4/1955 | Blakeman |

(Continued)

FOREIGN PATENT DOCUMENTS

| | | | |
|---|---|---|---|
| DE | 2000 6311 | U1 | 8/2001 |
| EP | 0 405 204 | A2 | 1/1991 |

(Continued)

OTHER PUBLICATIONS

English-language translation of Office Action issued in Korean Application No. 10-2005-701487 on Sep. 17, 2010.

(Continued)

*Primary Examiner* — Shay Karls

(74) *Attorney, Agent, or Firm* — Oliff PLC

(57) ABSTRACT

The invention relates to a toothbrush that is produced by AFT and has a head part and at least one carrier element connected thereto. A front surface of the head part is formed by the top surfaces of the at least one carrier element and has a non-planar three-dimensional configuration, or is capable of assuming such a configuration during intended use. The invention also relates to a process for producing such a toothbrush.

39 Claims, 16 Drawing Sheets

Related U.S. Application Data continuation of application No. 12/805,064, filed on Jul. 9, 2010, now Pat. No. 7,992,247, which is a continuation of application No. 12/379,992, filed on Mar. 5, 2009, now Pat. No. 7,774,891, which is a continuation of application No. 11/645,664, filed on Dec. 27, 2006, now Pat. No. 7,549,187, which is a continuation of application No. 11/291,911, filed on Dec. 2, 2005, now Pat. No. 7,162,767, which is a division of application No. 10/388,744, filed on Mar. 17, 2003, now Pat. No. 6,988,777.

(51) Int. Cl.

| | |
|---|---|
| *A46B 7/06* | (2006.01) |
| *A46B 15/00* | (2006.01) |

(56) References Cited

U.S. PATENT DOCUMENTS

| | | | | | |
|---|---|---|---|---|---|
| 3,082,457 | A | * | 3/1963 | Lucibello et al. | 15/167.1 |
| 4,211,217 | A | | 7/1980 | Gueret | |
| 4,291,431 | A | | 9/1981 | Lewis, Jr. | |
| 4,694,844 | A | * | 9/1987 | Berl et al. | 15/167.1 |
| 5,033,797 | A | | 7/1991 | Rueb | |
| 5,159,736 | A | | 11/1992 | Newell | |
| 5,325,560 | A | | 7/1994 | Pavone et al. | |
| 5,372,501 | A | | 12/1994 | Shalvi | |
| 5,483,722 | A | | 1/1996 | Scheier et al. | |
| 5,524,312 | A | | 6/1996 | Tan et al. | |
| 5,651,158 | A | | 7/1997 | Halm | |
| 5,875,510 | A | | 3/1999 | Lamond et al. | |
| 5,946,758 | A | | 9/1999 | Hohlbein et al. | |
| 5,964,508 | A | | 10/1999 | Maurer | |
| 6,044,514 | A | | 4/2000 | Kaneda et al. | |
| 6,115,870 | A | | 9/2000 | Solanki et al. | |
| 6,138,316 | A | | 10/2000 | Weihrauch | |
| 6,151,745 | A | | 11/2000 | Roberts et al. | |
| 6,161,245 | A | * | 12/2000 | Weihrauch | 15/201 |
| 6,290,303 | B1 | | 9/2001 | Boucherie | |
| 6,702,394 | B2 | | 3/2004 | Boucherie | |
| 6,886,207 | B1 | | 5/2005 | Solanki | |
| 6,996,870 | B2 | * | 2/2006 | Hohlbein | 15/110 |
| 7,354,112 | B2 | | 4/2008 | Fischer et al. | |
| 7,841,041 | B2 | | 11/2010 | Moskovich et al. | |
| 2001/0024060 | A1 | | 9/2001 | Boucherie | |
| 2001/0050507 | A1 | | 12/2001 | Boucherie | |
| 2003/0132661 | A1 | | 7/2003 | Sato et al. | |
| 2004/0074034 | A1 | | 4/2004 | Russell | |

FOREIGN PATENT DOCUMENTS

| | | | |
|---|---|---|---|
| EP | 0 519 677 | A1 | 12/1992 |
| EP | 0 567 672 | A1 | 11/1993 |
| EP | 0 704 179 | A1 | 4/1996 |
| EP | 0972 464 | A1 | 1/2000 |
| KR | 10-0403967 | | 6/2002 |
| WO | WO 94/22346 | A1 | 10/1994 |

OTHER PUBLICATIONS

Aug. 19, 2013 Notice of Allowance issued in U.S. Appl. No. 13/765,151.

Apr. 23, 2013 Office Action issued in U.S. Appl. No. 13/765,151.

* cited by examiner

TOOTHBRUSH AND PROCESS FOR PRODUCING THE SAME

CROSS-REFERENCE TO RELATED APPLICATION

This is a Continuation of application Ser. No. 13/765,151 filed Feb. 12, 2013 which in turn is a Continuation of application Ser. No. 13/067,844 filed Jun. 29, 2011 which in turn is a Continuation of application Ser. No. 12/805,064 filed Jul. 9, 2010 which in turn is a Continuation of application Ser. No. 12/379,992 filed Mar. 5, 2009 which in turn is a Continuation of application Ser. No. 11/645,664 filed Dec. 27, 2006, which in turn is a Continuation of application Ser. No. 11/291,911 filed Dec. 2, 2005, which in turn is a Division of application Ser. No. 10/388,744 filed Mar. 17, 2003. The entire disclosures of the prior applications are hereby incorporated by reference herein in their entireties.

BACKGROUND OF THE INVENTION

The invention relates to a toothbrush having a head part, a carrier element and a plurality of cutouts, and to a process which is intended for producing such a toothbrush that includes guiding the bristle filaments through the cutouts and connecting the carrier element to the head part. The invention also relates to a head part for a changeable-head toothbrush. The present application claims priority to German Application No. 102 59 723.5 filed Dec. 19, 2002.

Producing toothbrushes by AFT (Anchor Free Tufting) technology has great advantages in relation to the conventional bristle-covering operation, in which bristle filaments bent around anchors or clips are stuffed into the head part of the brush. Because the shape of the clusters of bristles is not predetermined by the size of the corresponding fastening means, more or less any desired bristle arrangements can be realized by means of AFT. In the case of AFT, use is made of a carrier plate with a plurality of cutouts through which clusters of bristle filaments are guided. The rear ends are then melted for permanent connection to the carrier plate. AFT technology is described, for example, in EP-A 0 972 464, EP-A 0 405 204 or EP-A 0 567 672. The bristle covered carrier plate is then connected to the head part of the toothbrush. Ultrasonic welding, which is described for example in DE-U 2000 6311, is preferred.

AFT technology straightforwardly allows the production of different bristle profiles, by the bristle filaments, which are guided loosely through the cutouts, being forced into the desired profile shape, using a template, before the incipient melting. However, the properties of a toothbrush or of its bristle arrangement, such as rigidity, wear and cleaning efficiency, are determined not just by the material selection and the profile shape, but also by the length and the setting angle of the bristles. Up until now, it was not possible for these parameters, in particular the bristle length and profile shape, to be varied independently of one another in order to optimize the cleaning properties further.

WO 94/22346 discloses a toothbrush with an inflection in the bristle-carrying head part, but does not describe the production process. The conventional bristle-covering operation of such a brush involves high outlay because it is only possible to compensate for height differences in the head part by compensating movements of the stopping tool.

SUMMARY OF THE INVENTION

The object of the invention is thus to provide a toothbrush which, along with straightforward production, allows the largely free selection of parameters of the bristle arrangement for the purpose of improving the cleaning performance. It is also intended to specify a corresponding production process.

The object is achieved by a toothbrush having a head part, a carrier element and a plurality of cutouts and by a process which is intended for producing such a toothbrush and that includes guiding the bristle filaments through the cutouts and connecting the carrier element to the head part. Advantageous developments of the invention can be gathered from the dependent claims, the description and the drawings.

The invention is based on a toothbrush produced by AFT. This toothbrush has a head part and at least one carrier element which is connected thereto and has a plurality of cutouts through which bristle filaments are guided and, for fastening on the carrier element, are melted by way of their rear ends. The top surface or the top surfaces of the at least one carrier element define a front surface of the finished head part. The front surface is that surface in which the roots of the bristles and of any other cleaning elements are located. According to the invention, this front surface has a non-planar three-dimensional configuration and/or is capable of assuming such a configuration during intended use. A suitable selection of the topography, i.e., of the non-planar shape of the front surface in the rest state and/or under loading, makes it possible to produce a multiplicity of bristle arrangements. In particular, it is easily possible to vary the bristle length and the setting angle relative to the plane of the actual head part.

Toothbrushes with such a static and/or dynamic topography can be realized in different ways according to the invention.

A first possibility is to use a flexible carrier element which consists, for example, of a thin hard material or at least partially of a soft material, with the result that dimensional and material elasticity is provided. This carrier element is preferably flat before it is installed in the head part, with the result that it can easily be covered with bristles. The hot die used for melting the bristle ends can provide a hard material with the desired top-surface shape, which may additionally be fixed by the bristle melt. Alternatively, in the case of a partially flexible carrier element, the topography is only produced during insertion into the head part or during use. It is possible for a shape which is flat in the rest state to be provided.

In the case of carrier elements with a soft component, the bristles are retained, at least in a subregion, by the elastic material and are thus mounted in a flexible manner. In order to achieve sufficient flexibility, it is preferable for the Shore A hardness of the elastic material to be selected to be below 70, for the carrier-plate thickness to be selected to be below 4 mm and for the layer thickness of the melted material to be selected to be below 1 mm. A topography which is flat or convex in the transverse and/or longitudinal direction of the head part is preferably selected, in order that a change in topography takes place during use.

Two-component carrier elements have the advantage that the hard component simplifies the ultrasonic welding, and may also serve as an anchoring means for the bristles, and the soft component ensures the desired elasticity and/or deformability.

Possible hard materials are the materials used for producing the head part, in particular polyethylene (PE), polypropylene (PP), PET, acrylonitrile-butadiene-styrene (ABS), styrene-acrylonitrile (SAN). An in particular thermoplastic elastomer e.g., TPE, TPU, rubber, silicone, is preferably used as the soft material. In the case of a two-component configuration of the carrier element, said soft material is coordinated with the hard material, with the result that a non-releasable connection is produced.

A further possibility for a toothbrush according to the invention consists in using a rigid carrier element of which the top surface already has the desired topography. The rear surface may be configured to follow the profile of the top surface. Alternatively, the rear surface is planar, with the result that the carrier element has different thicknesses. The first variant has advantages in respect of the material consumption and the cooling times, although the AFT die has to be adapted to the shape of the rear side. In the case of the second variant, it is possible to use a conventional heating die with a planar front.

A further possibility for a toothbrush according to the invention consists in using a plurality of carrier elements, which in this case may also have a planar top surface. The desired topography is predetermined by the shape of the head part and/or the shape of the carrier elements, in particular by the position and alignment of the regions which are prepared for accommodating the carrier elements. According to the invention, the carrier elements are inserted at different heights and/or different orientations. It is thus advantageously possible for different bristle arrangements to be realized from a plurality of elements, in the manner of a construction kit, without new carrier plates having to be produced in each case. The carrier elements can be covered with bristles in parallel in the AFT machine, i.e., in one operation as a single-part bristle arrangement. In addition, zones with flexible components, e.g., flexible zones or cleaning elements, may be set up between the carrier elements.

The carrier element or the carrier elements is/are preferably connected to the head part by means of ultrasonic welding. In order to ensure satisfactory welding between these parts, the welding surface is preferably located in a single plane. The desired topography is thus preferably only formed within the region defined by the welding surface. For example, a peripheral welding border is formed in the border region of the rear surface, this border interacting with a corresponding mating surface on the head part. If this is not possible, for example because the carrier element has steps or other sudden changes in topography, it is possible to dispense with welding specifically in these regions. It is preferable, however, to utilize at least 25% of the theoretically possible welding surface on the periphery of the head.

The same material is advantageously used for the carrier element, or the hard component thereof, and the head part. The two parts are advantageously assembled in a largely flush manner, i.e., within the production tolerances, without edges or grooves. However, it is often not possible, in practice, to prevent a depression from forming on the boundary surface, allowing for deposits to form in said depressions. In order for these deposits not to be obvious to the user, the head part and carrier element are particularly preferably made of different colors.

In a development of the invention, the material of the carrier element comprises additives, such as flavorings, temperature indicators or antibacterial substances. Such additives are expensive and, rather than being used in the entire head part including the handle, by being provided on the carrier element are thus advantageously used only in the actual target region, i.e., during intended use, in the mouth.

BRIEF DESCRIPTION OF THE DRAWINGS

Examples of the invention are described hereinbelow and illustrated in the drawings, in which.

DETAILED DESCRIPTION OF EXEMPLARY EMBODIMENTS

Figure 1B:
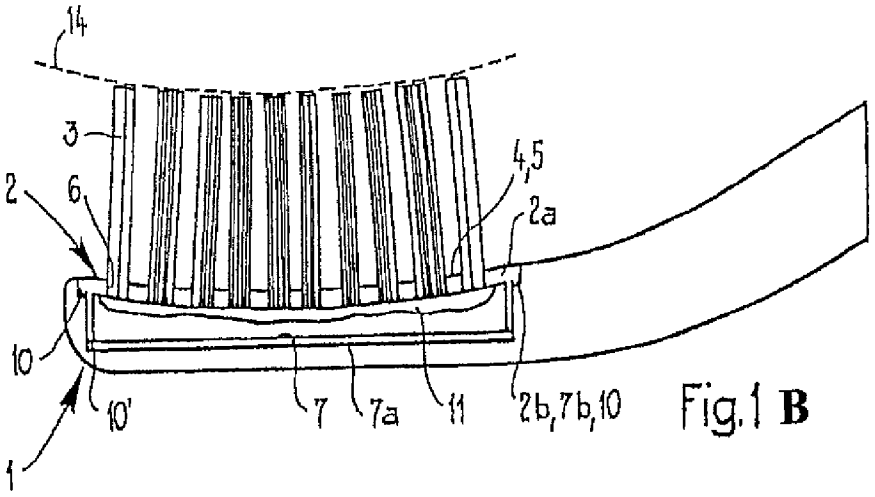
FIGS. 1A-1C show a toothbrush according to the invention with a rigid curved carrier element.

All of the toothbrushes shown in the figures have a handle part (not illustrated), a head part 1 and at least one carrier element 2 which is, or can be, connected thereto and has been covered with clusters of bristles 3 by AFT. According to the invention, the front surface 5 of the finished head part, said surface, in the cases with just one carrier element 2 (see FIGS. 1-4, 6-8, 10, 12-16), largely corresponding with the top surface 4 of the latter, has a non-planar configuration in the rest state and/or during use. It is arched inward, i.e., in the direction of the head part 1, in FIG. 1, arched outward in FIGS. 2, 12-14, 16, of undulating form in FIGS. 3 and 8, planar, but compliant, in FIG. 15, and provided with inflections or steps in the rest of the figures. By this means, and by corresponding selection of the bristle lengths, it is possible to produce bristles profiles 14, 15 which differ in the longitudinal and transverse directions in relation to the head part 1 and have different levels of rigidity for the clusters of bristles 3.

The carrier element 2, for the purpose of accommodating the clusters of bristles 3, has a plurality of cutouts 6 running between its top side 4 and its rear surface 8. By virtue of the alignment of these holes 6, it is possible to adjust the setting angle of the clusters of bristles 3. In terms of production, however, it is preferred for the holes 6 to run in the direction of the normal of the top surface 4. For fastening on the carrier element 2, the rear ends 3*a* of the clusters of bristles 3 are melted by a heating die 12 (see FIG. 1C), with the result that a bristle coating 11 is produced. It is possible to provide further cleaning elements 19 which are made of flexible material (see FIGS. 5A and 5B) and have preferably been produced during the production of the carrier element 2 by two-component injection molding, before the bristle-covering operation. Even if the carrier element 2 itself consists of soft material and hard material, two-component injection molding is preferably used in order to produce it.

The carrier element 2, alongside the actual bristle-carrying surface 2*a*, has a preferably peripheral border part 9 projecting from the rear side 8 thereof. This border part serves, on the one hand, for centering purposes during insertion into correspondingly adapted cutouts 7 in the head part 1 and, on the other hand, for realizing welding surfaces 10, 10' for ultrasonic welding. The border 9 also serves as a lateral boundary for the bristle melt 11.

Figure 1C:
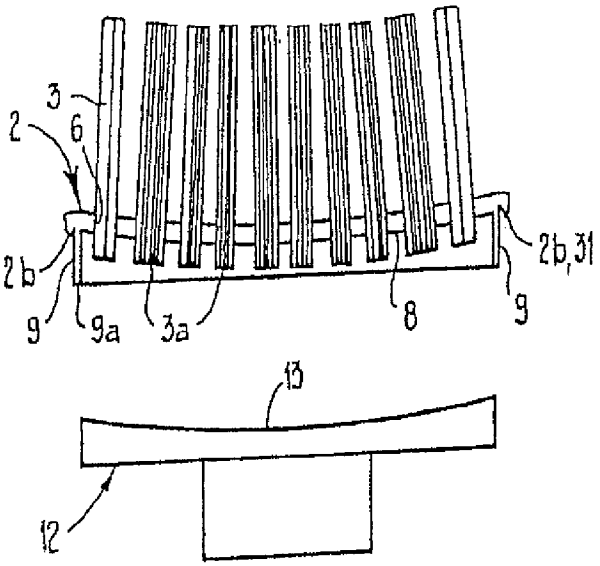
Figure 1A:
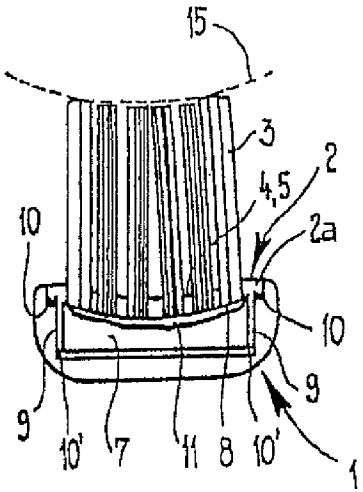

In the case of the toothbrush shown in FIGS. 1A and 1B, the carrier element 2 consists of a hard material, is largely rigid and is already arched concavely, both in the longitudinal direction and in the transverse direction, before it is installed in the head part 1. Its top side 4 and underside 8 run parallel to one another. The material thickness is preferably less than 5 mm, particularly preferably less than 3 mm. The bristles are all the same length, with the result that a bristle profile 14, 15 which follows the profile of the top surface 4 and of the front surface 5, and is concave in the longitudinal and transverse direction, is produced.

As is shown in FIG. 1C, the clusters of bristles 3 are first of all inserted into the cutouts 6 in the carrier element. A heating die 12, of which the top side 13 is adapted to the profile of the rear side 8 of the carrier element, is used to melt the bristle ends 3*a*, with the result that the bristle coating 11 is formed. In the case of a contoured die, the bristle melt is advantageously of constant thickness throughout. Then, the carrier element 2 is connected to the head part by means of ultrasonic welding. For this purpose, the surface 2*a* projects laterally, beyond the border part. The resulting shoulder 2*b* comes into abutment against a shoulder 7*b* of the cutout 7 during insertion into the head part 1, it being possible for the contact surface to serve as welding surface 10.

Furthermore, it is also possible for the bottom end 9*a* of the border part 9, together with the base 7*a* of the cutout 7, to serve as welding surface 10'. For this purpose, the parts 2*b* and/or 9*a* may have a tapered border 31 (see FIGS. 1C, 15A and 16A), these serving, during the welding operation, as an energy concentrator and a reservoir for material which is to be liquefied.

Figure 2B:
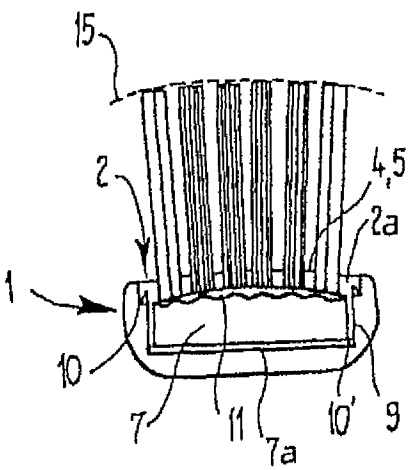
FIGS. 2A and 2B show a toothbrush with an elastic curved carrier element.
Figure 2A:
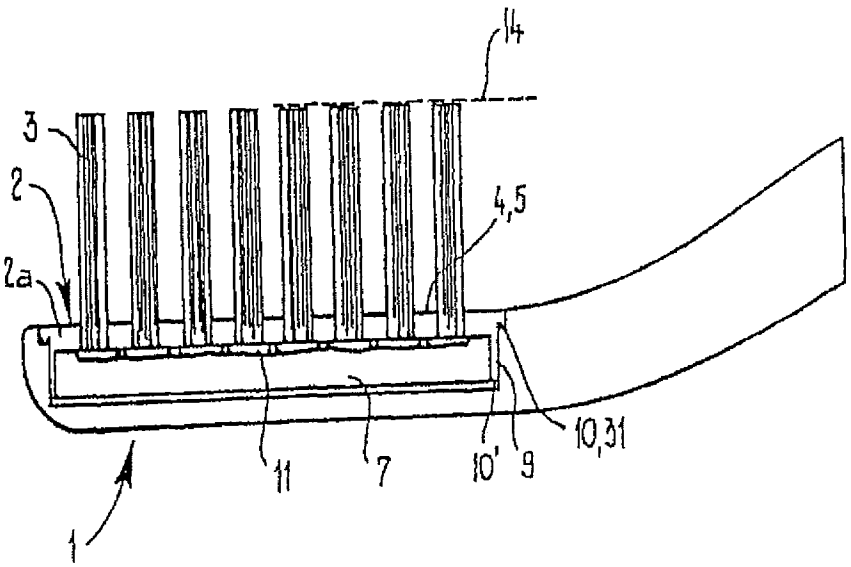

In the case of the example from FIGS. 2A and 2B, the carrier element 2, or the bristle-carrying surface 2*a* thereof, consists largely of a thin hard material. It is flat when not covered with bristles and is thus easy to cover with bristles. During the bristle-covering operation, it is moved by the heating die into the arched shape illustrated and inserted into the cutout 7, with the result that it arches outward in the transverse direction and the clusters of bristles 3 are fanned out relative to one another. This produces a longitudinally flat and transversely convex bristle profile 14 and 15, respectively. Tests show that the bristle melt 11 adapts itself to the topography without fracturing. The carrier element 2 is then connected to the head part 1. In order to avoid material incompatibilities during ultrasonic welding, the border part 9 preferably consists of the hard component.

As an alternative, the carrier element 2 may also consist of a flexible material or thin hard material which is flexible enough in order, following the bristle covering operation, to be inserted into the head part in the flat state, under prestressing and arching action. For this purpose, the material thickness of the hard material is preferably not more than 3 mm. The deformable part of the carrier plate is subjected to pre-stressing by the deformation, with the result that the flexibility which is present in this region during use can also be determined to a considerable extent by the production of the brush.

Figure 3B:
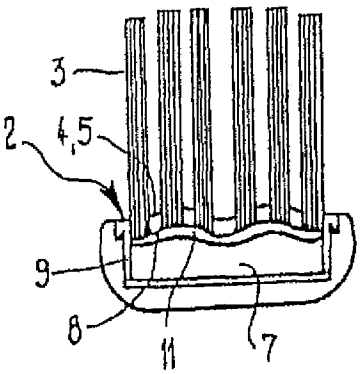
FIGS. 3A and 3B show toothbrushes with a carrier element with an undulating top surface.
Figure 3A:
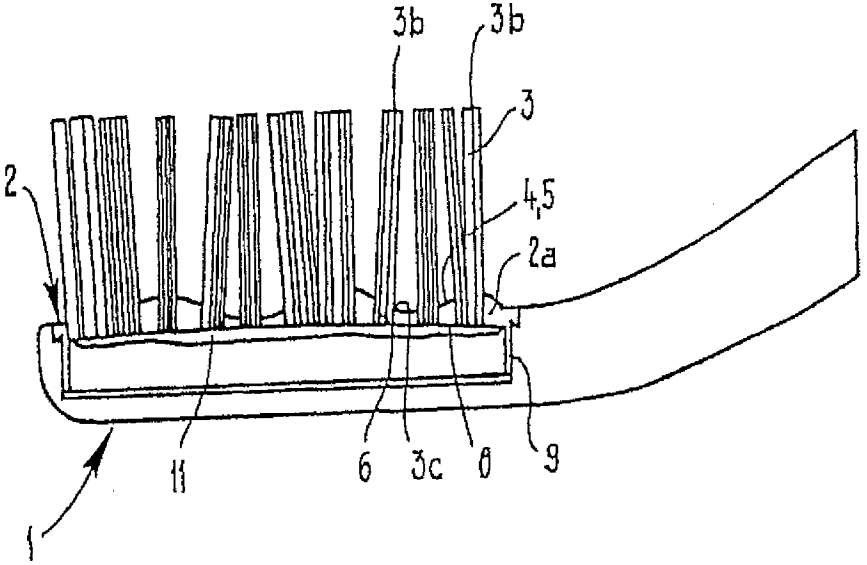

FIG. 3A shows a longitudinal section of a toothbrush with a rigid carrier element 2, of which the top surface 4 is of undulating form and the rear surface 8 is flat. The thickness of the bristle-carrying surface 2*a* is preferably between not less than 3 mm and not more than 10 mm. Although all of the clusters of bristles 3 are in fact of the same basic length, their free lengths from the root 3*c* on the top surface 4 as far as their front end 3*b* differ on account of the height profile of the plate 2*a*, with the result that different elastic properties of the bristles are realized. The angle of the cutouts 6, and thus the setting angle of the bristles, likewise varies. By means of such a carrier element, it is thus easy to produce bristle plates with different free bristle lengths and profile shapes, by use of a conventional flat AFT heating die.

FIG. 3B shows a cross section of modification of the example from FIG. 3A, in the case of which the profile of the underside 8 has been adapted to that of the top side 4. The advantages are material-related savings and shorter cycles during the production of the carrier elements 2 on account of quicker cooling. However, it is necessary to use a heating die which is adapted to the underside 8.

Figure 4B:
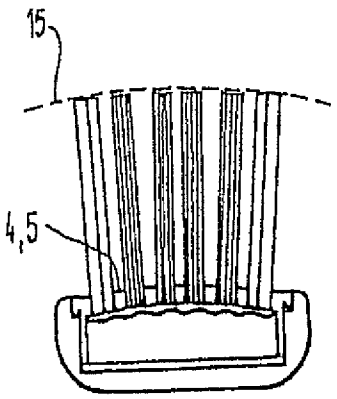
FIGS. 4A and 4B show a toothbrush with a carrier element with a step.
Figure 4A:
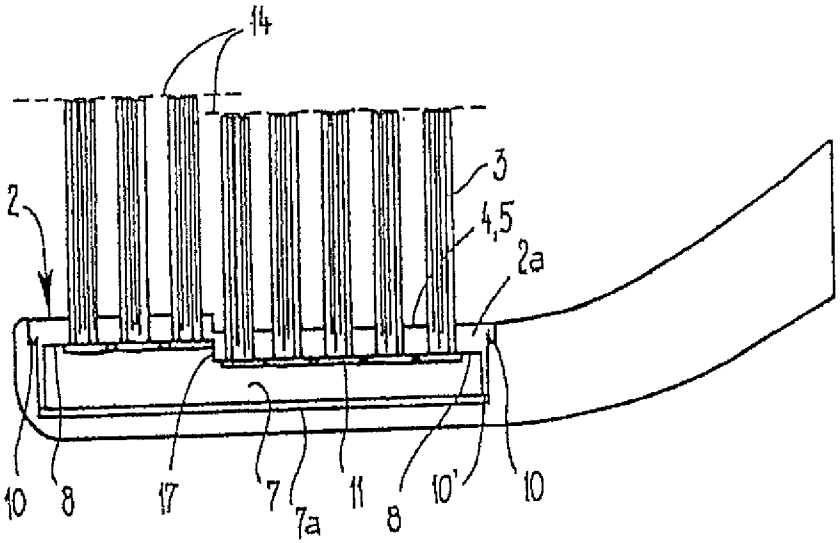

The toothbrush shown in FIGS. 4A and 4B has a carrier element 2 of which the bristle-carrying surface 2*a* has a step 17 on the top side 4 and underside 8. The bristle profile 14 in the longitudinal direction follows the profile of the top surface 4 or front surface 5. Possible welding surfaces, once again, are the surface 10, already described in conjunction with FIG. 1, beneath the surface 2*a* and the surface 10' on the base of the cutout 7. The latter is preferred since, on account of the planar base 7*a*, it is possible to form a continuous welding surface 10'. In the case of the welding surface 10, there is a non-welded location at the topography step 17. The profile of the bristle ends and the front surface 5 in the transverse direction is arched outward (FIG. 4B) and corresponds, in section, to FIG. 2B.

Figure 5A:
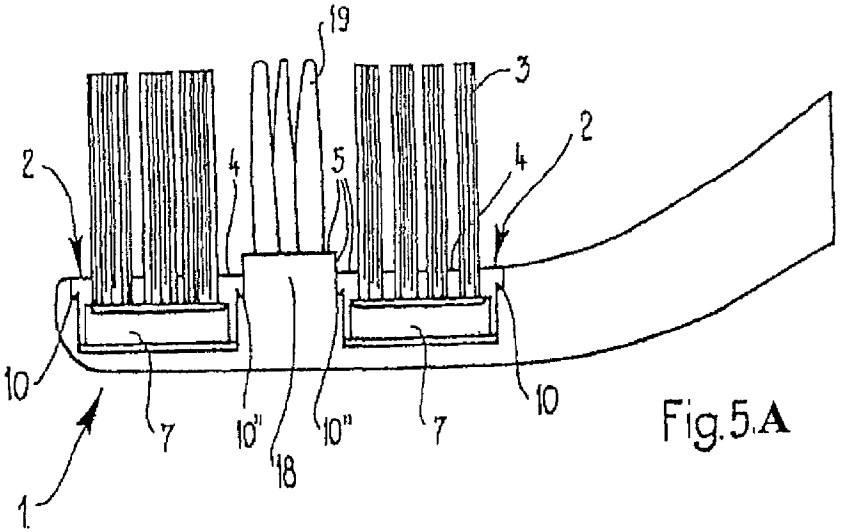
FIGS. 5A and 5B show a toothbrush with two carrier elements and a shoulder located therebetween.
Figure 5B:
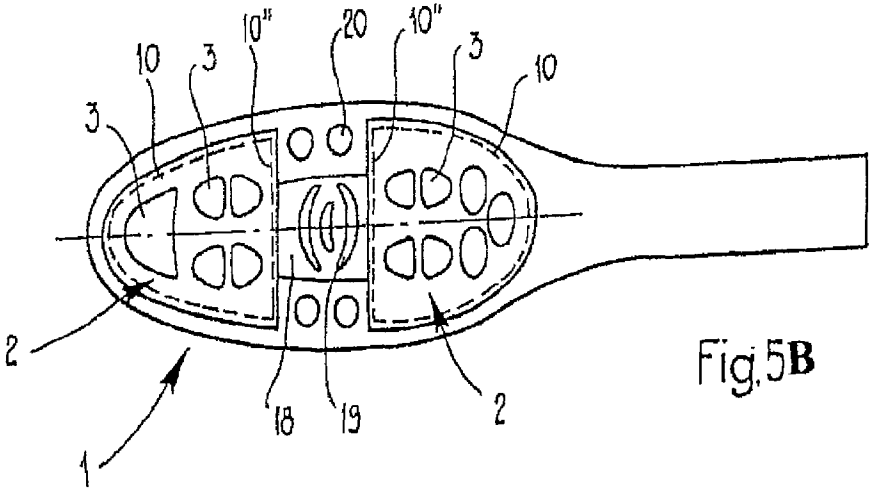

FIGS. 5A and 5B show a toothbrush with two carrier elements 2 which are arranged in two cutouts 7 to the sides of an elevated region 18 in the center of the head part 1. This produces a front surface 5 with two different levels. The carrier elements 2 are fastened, as has been described above, by ultrasonic welding along the welding surface 10 on the border of the carrier elements 2, said welding surface being located outside the bristle arrangement, as seen in plan view (FIG. 5B). It is also possible to weld just the surfaces on the periphery of the head part 1, while the surfaces 10" adjacent to the elevated region 18 remain unwelded. A sufficient hold is achieved by welding at least 25% of the possible contact surfaces. The non-welded surfaces 10" can provide the brush here with flexibility, in particular if the elevated region 18 consists of an elastic material, with the result that the brush head yields in a partially resilient manner during use.

Figure 9A:
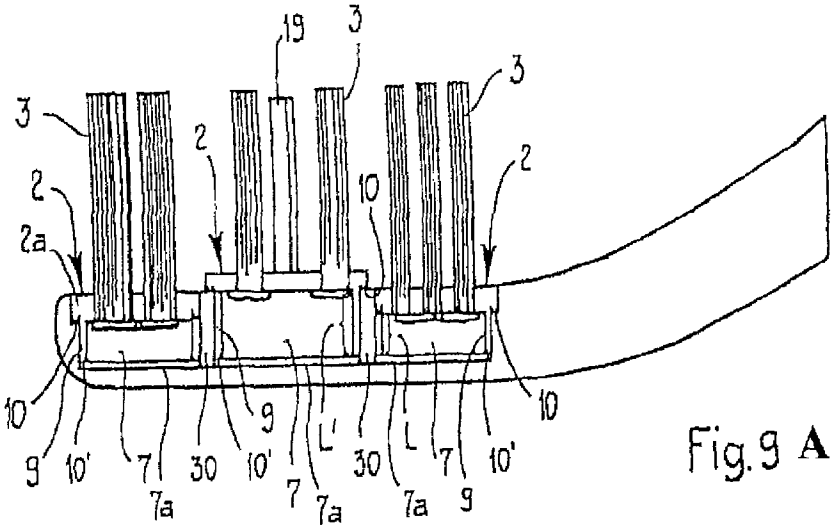
FIGS. 9A and 9B show a toothbrush with three carrier elements.
Figure 9B:
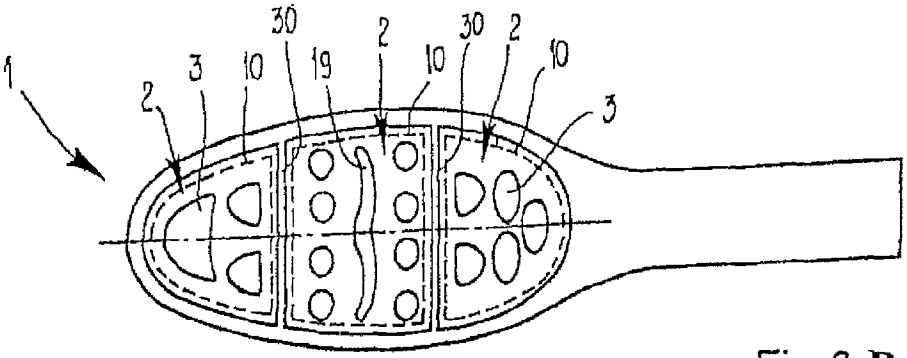

Flexible cleaning elements 19 are arranged on the elevated region 18. Further in particular also flexible cleaning elements 20 are located outside the elevated region 18. The head part 1 has been produced with these elements, and the possibly provided elastic zone, by two-component injection molding. The elevated region 18 may also be realized by a further carrier plate which, as in the example of FIGS. 9A and 9B, is fitted precisely, with the two other carrier elements 2, into a common cutout 7.

Figure 6A:
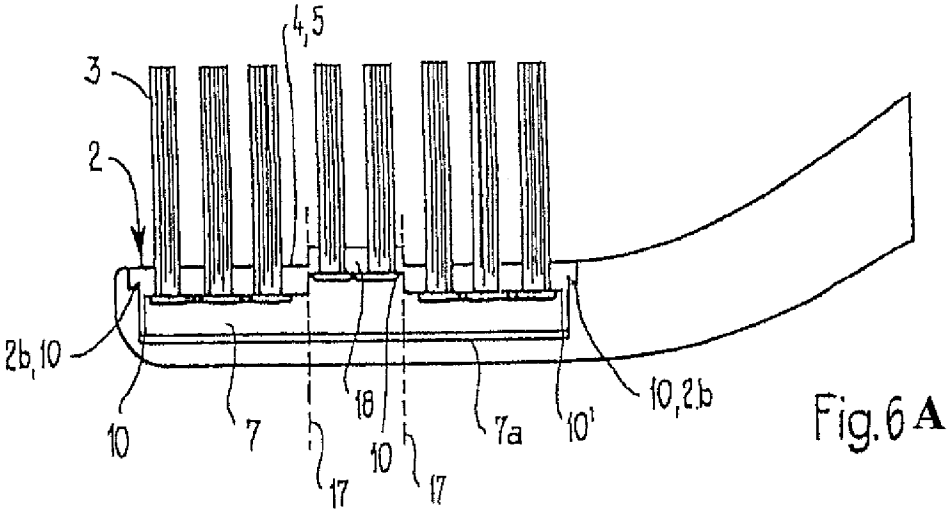
FIGS. 6A and 6B show a toothbrush with a carrier element comprising three segments.
Figure 6B:
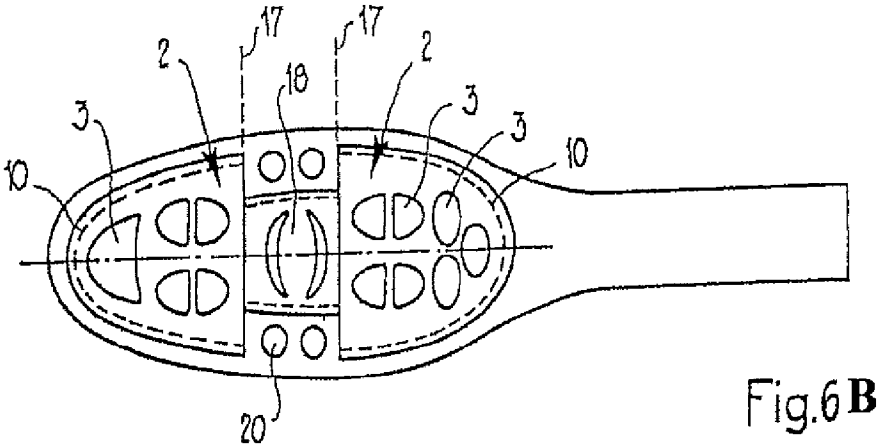

FIGS. 6A and 6B show a similar toothbrush, although in this case the central elevated region 18 is realized by a single carrier element 2 with a stepped height profile. This is narrower in the central region 18, and the shape of the cutout 7 is adapted thereto. Welding takes place beneath the border 2*b* of the carrier element 2 and in the border regions of the elevated region 18, with the result that the welding surface 10 runs on two levels. No welding takes place at the step locations 17. As an alternative, welding takes place on the base 7*a* of the cutout 7, along the surface 10'.

Figure 7A:
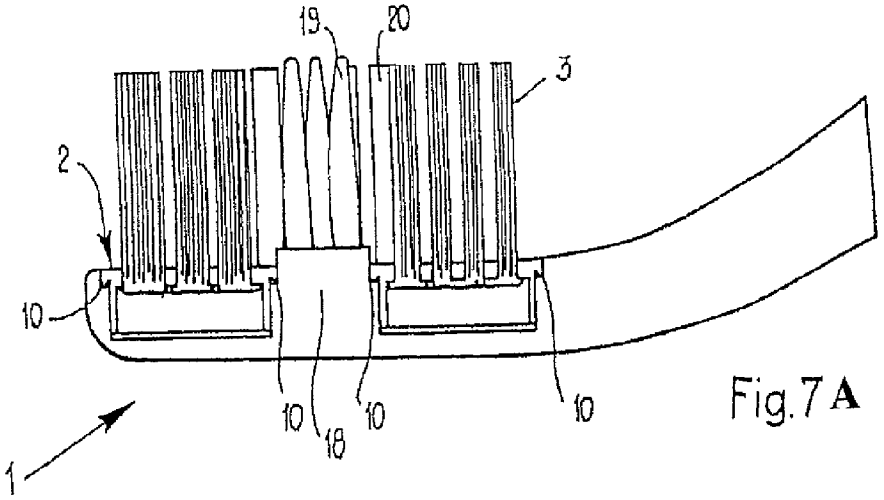
FIGS. 7A and 7B show a toothbrush with a carrier element with a platform-like elevation.
Figure 7B:
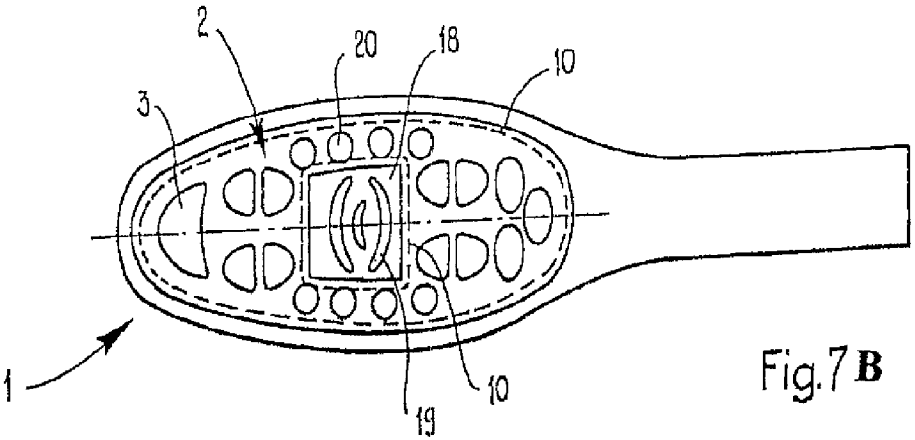

FIGS. 7A and 7B show a further toothbrush with a centrally elevated region 18. The carrier element 2 has a central hole, with the result that it can be fitted over the elevated region 18. The carrier element 2 is welded to the head part 1 along the hole and on its outer border, as a result of which additional stiffening is achieved. Clusters of bristles 3 and flexible elements 20 are located on the carrier element 2.

Figure 8B:
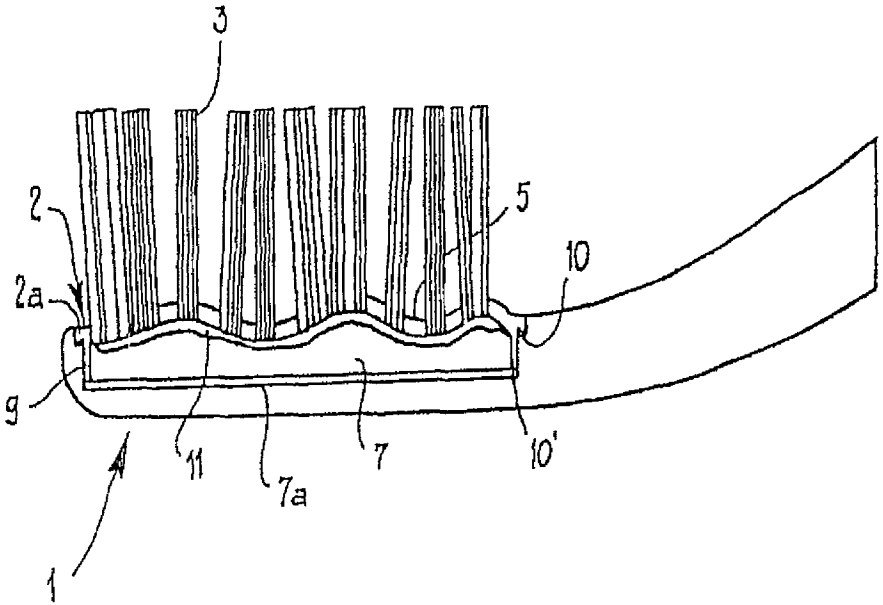
FIGS. 8A and 8B show a toothbrush with a carrier element with an undulating top surface.
Figure 8A:
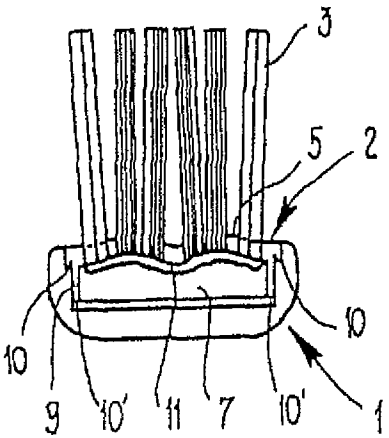

The carrier element 2 of the toothbrush shown in FIGS. 8A and 8B is of undulating form in the longitudinal and transverse directions, this resulting in a correspondingly structured front surface 5. The bristle-carrying surface 2*a* is also curved at the border, with the result that the contact and welding surface 10 is likewise curved. As an alternative, welding may take place in a single plane on the base 7*a* (welding surface 10').

FIGS. 9A and 9B show a toothbrush with two different levels, realized by three separate carrier elements 2 with border parts 9 of different lengths L, L'. These are inserted into three cutouts 7 separated by webs 30 or into a common cutout (not illustrated) and welded on the base 7*a* thereof (welding surface 10'). As an alternative, welding may also take place on two levels on the surface 10, beneath the respective bristle-carrying surfaces 2*a*. The central carrier element 2 comprises both conventional bristles and a flexible cleaning element 19.

Figure 10:
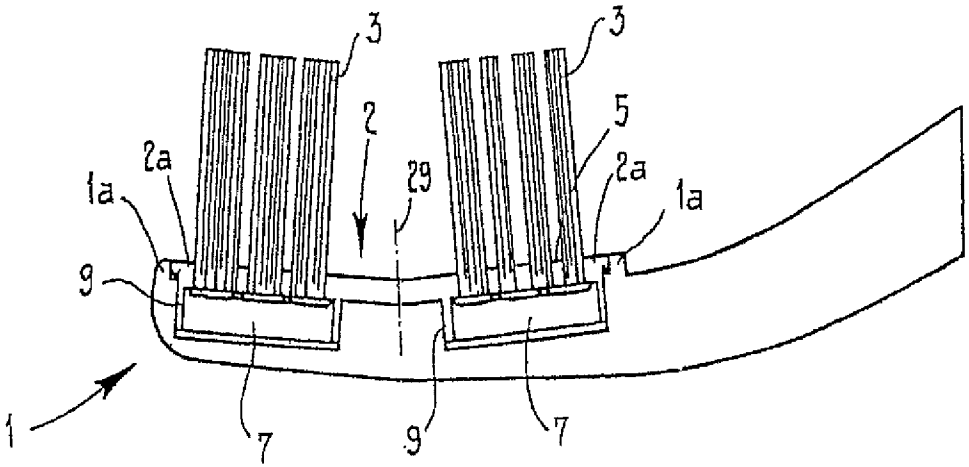
FIG. 10 shows a toothbrush with an inflected carrier element.

FIG. 10 shows a toothbrush with an inflected carrier plate 2. The shape of the head part 1 and/or of the cutout 7, as is also the case in the rest of the examples, is selected such that the border of the bristle-carrying surface 2*a* terminates flush with the head part, i.e., the top side 1*a* of the head part 1 here likewise has an inflected profile. Two anchoring regions with border parts 9 are provided here, as are, correspondingly, also two cutouts 7 adapted thereto. As an alternative, the inflected front surface 5 may also be realized by two separate carrier plates which are adjacent to one another at the inflection 29, it additionally being possible to provide the head part 1 with a zone which is flexible in the region of the inflection 29.

Figures 11A, 11B, 11C:
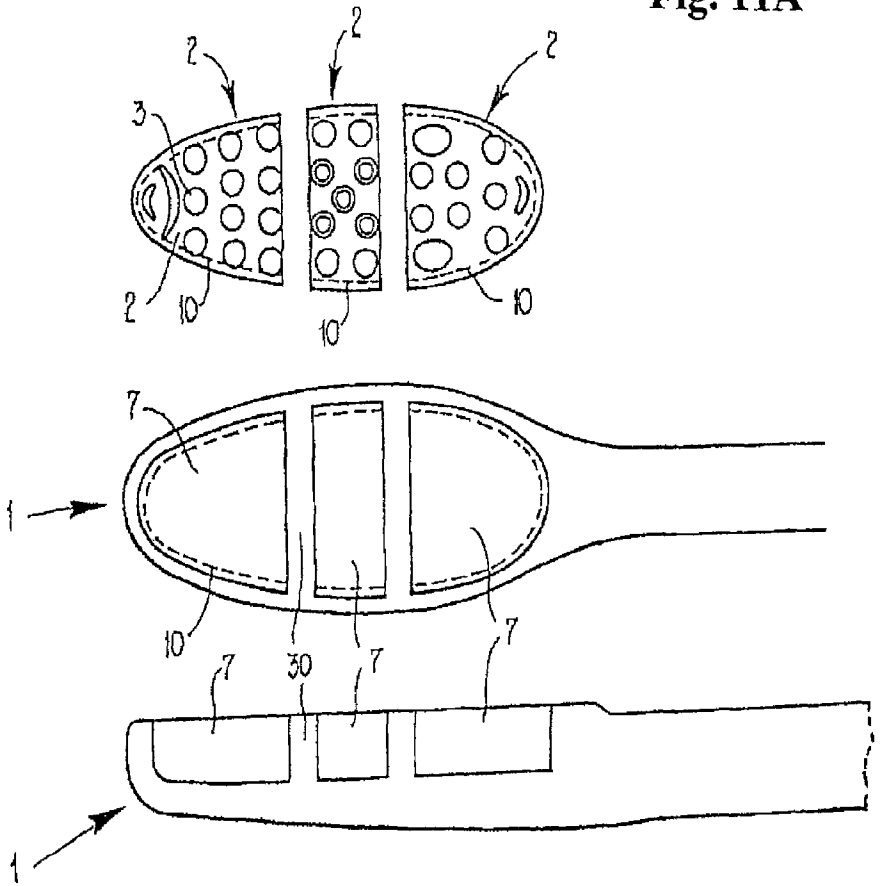
FIGS. 11A-11C show a head part for a toothbrush with three carrier elements.

FIGS. 11A-11C show a head part 1 for a toothbrush with three carrier elements 2. Three cutouts 7 are provided for accommodating the latter, transverse webs 30, in particular made of flexible material, being arranged between the individual cutouts. Welding takes place only on the periphery of the head part 1, along the line 10. The front surface may be designed, for example, as in FIG. 9.

Figure 12B:
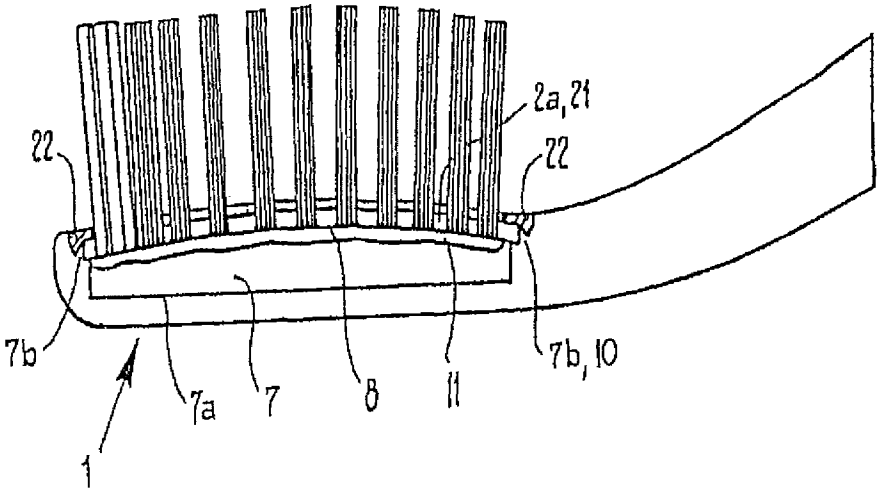
FIGS. 12A and 12B show a toothbrush with a carrier element with a soft component and a hard component.
Figure 12A:
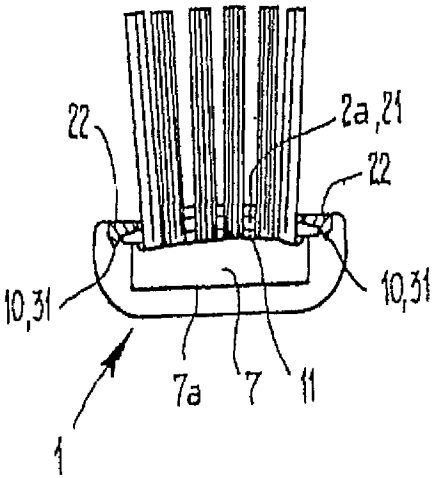

FIGS. 12A and 12B show a toothbrush with a carrier element with a soft component and a hard component. The actual bristle-carrying part 2*a* of the carrier element 2 is formed from a soft material 21, which is elastically deformable. The bristles are thus suspended and/or anchored in an elastic manner. The cushion-like part 21 yields under loading, which is particularly advantageous for the teeth. For easier connection to the head part 1, the carrier element 2 has a peripheral frame part 22 made of preferably the same hard material as the head part. The arching is produced during the production of the carrier element 2. The underside of the frame part 22 rests on corresponding shoulders 7*b* in the recess 7 in the head part 1, the contact surface defining the welding surface 10. The cavity between the underside 8 of the carrier element 2 and the base 7*a* of the cutout 7 allows, during use, a certain deflection of the elastic part 21, and in some circumstances even a reversal from the convex state to the concave state.

Figures 13A, 13B, 13C:
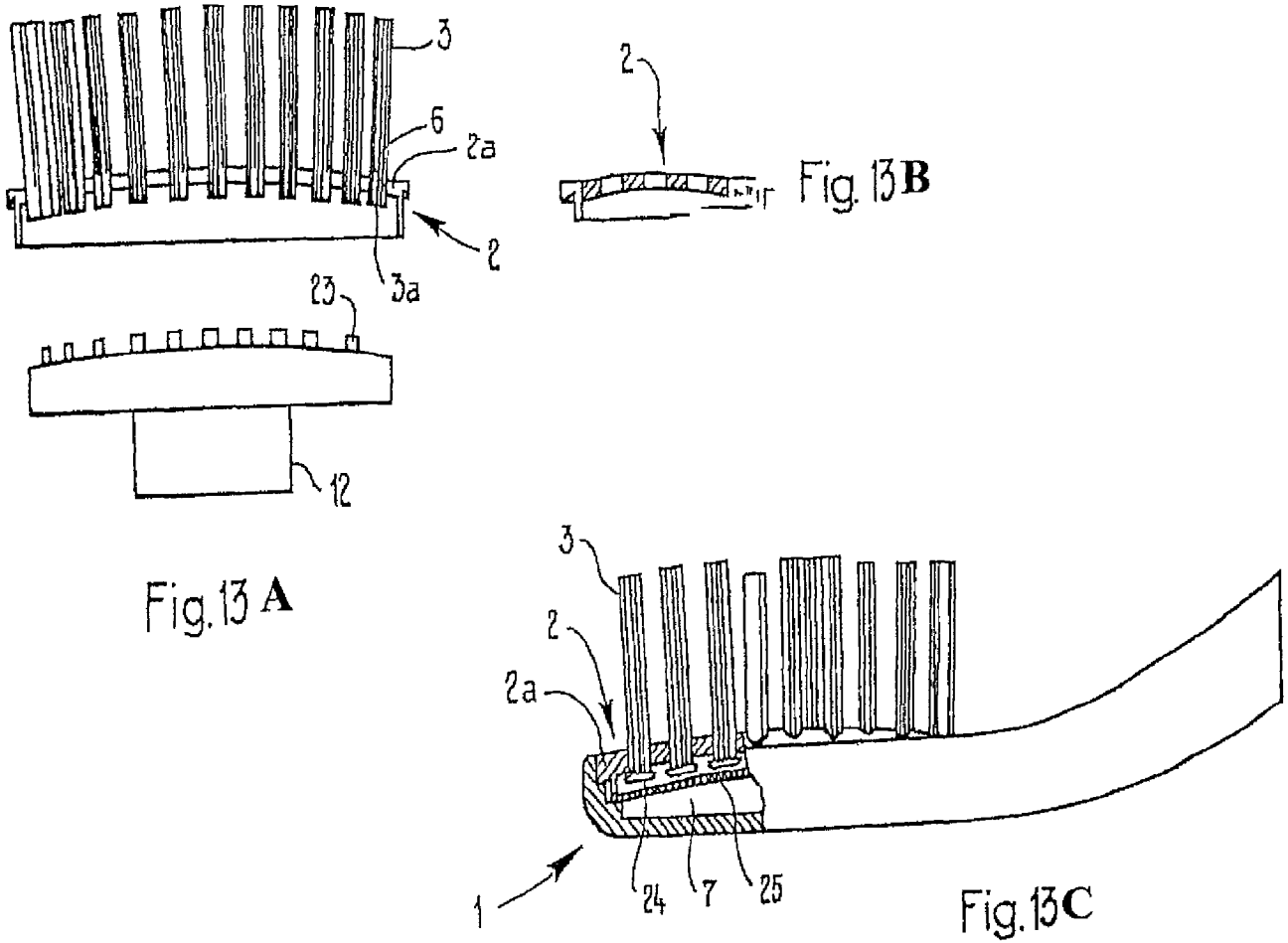
FIGS. 13A-13C, and FIG. 14 show toothbrushes with a curved carrier element and bristles which can be moved relative thereto.
Figure 14:
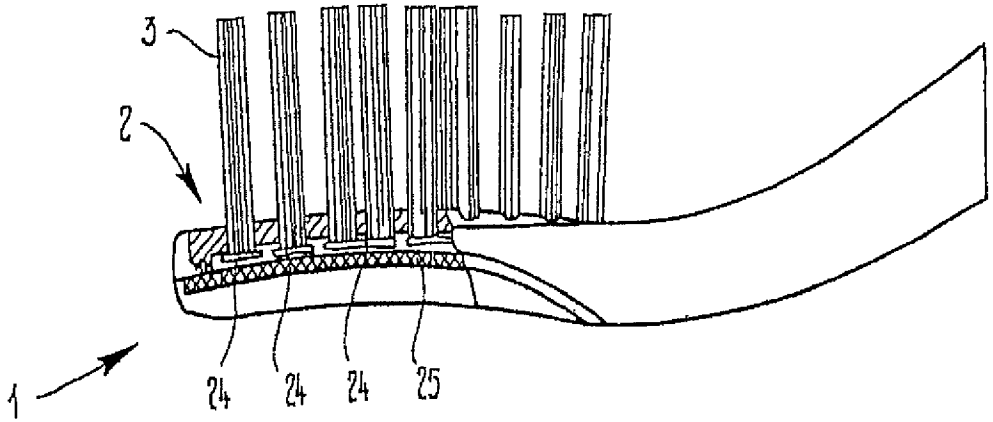

FIGS. 13A-13C and FIG. 14 show a carrier element and the head part of the toothbrush in the case of which the rear ends 3*a* of the clusters of bristles 3, rather than being firmly fused to the bristle-carrying surface 2*a*, can be displaced in the holes 6. This is achieved by suitable material selection, e.g., polypropylene for the carrier element and polyamide for the bristle filaments. Furthermore, rather than being melted to form a uniform bristle coating, the rear ends 3*a* are melted, by a heating die 12 having protrusions 23, to form separate webs 24 made of bristle melt. For the resilient mounting of the clusters of bristles 3, an elastic membrane 25 is arranged in the head part. In the case of FIG. 13C, this membrane is arranged within a cutout 7 and is placed in position before the carrier element 2 is fitted. In the case of FIG. 14, it forms an outer surface of the head part. It is molded on during the production of the head part. The rear bristle ends 3*a*, which are melted in a die-like manner, are forced upward by the membrane, with the result that the bristle-carrying surface 2*a* arches to form a cushion.

Figures 15A, 15B, 15C, 15D, 16A, 16B, 16C:
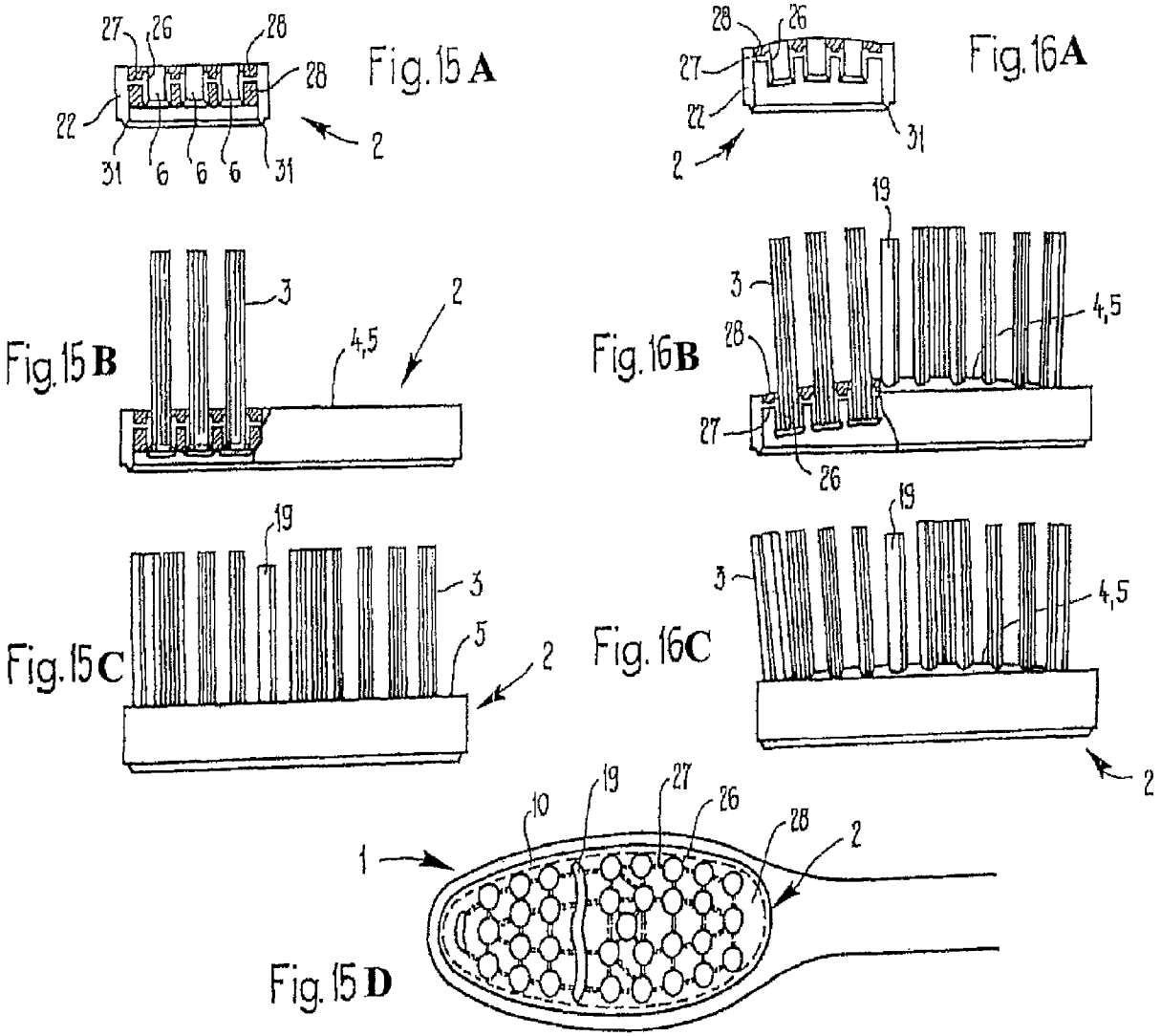
FIGS. 15A-15D and FIGS. 16A-16C show toothbrushes with a carrier element with a hard component in the form of a lattice.

FIGS. 15A-15D and FIGS. 16A-16C show toothbrushes with a two-component carrier element 2. The latter comprises a hard component in the form of a lattice, in this case formed from sleeves 26, with holes 6 for accommodating clusters of bristles, and webs 27 which connect said sleeves. Also provided is a frame part 22 which is made of the hard component and of which the edge 31, which in the application case is directed toward the base, is of tapered configuration and serves as welding surface 10. The region between the sleeves 26 is filled with an elastic soft material 28. In the example from FIG. 15, the material 28 is injected above and beneath the webs. This produces a flat elastic structure, i.e., a toothbrush with a flat front surface 5 which deforms during use. In the example from FIG. 16, the material 28 is only injected above the web. The shape of the top surface 4 is influenced by the shape of the injection mold. In the case of FIG. 16, this is selected so as to produce a cushion which yields during use. FIG. 15D shows the view of a head part 1 with the carrier element 2 inserted, the webs 27, which connect the sleeves 26 and are covered by soft material 28, only being depicted for explanatory purposes.

Figure 17B:
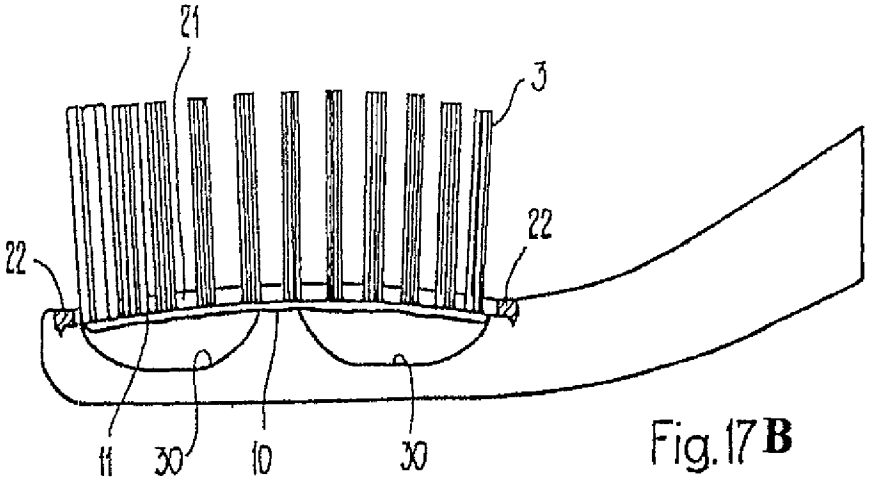
FIGS. 17A-17C show a toothbrush with a carrier element which is only connected to it at certain points.
Figure 17C:
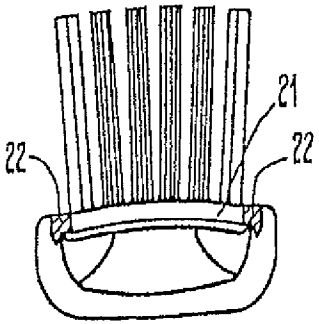
Figure 17A:
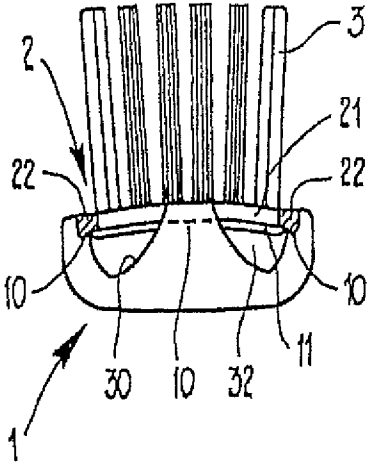

FIGS. 17A and 17B show the side view, in the longitudinal and transverse directions, of a further toothbrush, in the case of which the carrier plate 2 is only welded to the head part 1 in four subregions 10. This four-point suspension renders the carrier plate particularly compliant. For this purpose, the head part has lateral cutouts 30 through which a cavity 32 beneath the carrier plate is accessible. The carrier plate is spaced apart from the head part there to a considerable extent, i.e., by more than 0.5 mm. Deposits between the brush head and carrier plate may thus be washed out to good effect. The carrier plate consists predominantly of elastomeric material or of a thin layer, e.g., less than 1 mm, of a hard component and can be deflected in a flexible manner in relation to the welding surfaces 10. The carrier plate is preferably provided with a lateral border of 2 mm or more (not shown here) in order that the unsightly bristle melt is not visible to the user. All of the variants described above may also be realized as exchangeable heads, without the carrier element being permanently welded to the toothbrush handle. It is also possible for the flexible carrier plate to perform a sensor function, e.g., for monitoring the contact pressure.

While the invention has been described with reference to exemplary embodiments thereof, it is to be understood that the invention is not limited to the disclosed embodiments or constructions. To the contrary, the invention is intended to cover various modifications and equivalent arrangements. In addition, while the various elements of the embodiments are shown in various combinations and configurations, which are exemplary, other combinations and configurations, including more, less or a single element, are also within the spirit and scope of the invention.

What is claimed is:

1. A toothbrush, comprising:

a handle part;

a head part connected to the handle part, the head part having a front face and a rear face, and the head part being made of a hard material; and at least one carrier element connected to the head part, the at least one carrier element having a top surface, a rear surface and clusters of bristle filaments having the rear end melted to form a bristle melt, wherein the head part contains an elastic material integrally moulded with the head part, and the elastic material is coordinated with the hard material to thereby form a non-releasable connection.

2. The toothbrush according to claim 1, wherein the elastic material is supporting the bristle melt of the rear bristle ends.

3. The toothbrush according to claim 1, wherein the elastic material is forcing up the bristle melt of the rear bristle ends.

4. The toothbrush according to claim 1, wherein the elastic material is located between the rear face of the head part and the carrier element.

5. The toothbrush according to claim 1, wherein the elastic material is located on the rear face of the head part.

6. The toothbrush according to claim 1, wherein the head part containing a membrane formed by the elastic material.

7. The toothbrush according to claim 6, wherein the membrane forms an outer surface of the head part.

8. The toothbrush according to claim 6, wherein the membrane, according to a cross sectional side view, runs in an arch-shaped manner through the head part.

9. The toothbrush according to claim 1, wherein the bristle melt is forming separate webs.

10. The toothbrush according to claim 1, wherein the elastic material, according to a cross sectional side view, protrudes over the front end of the at least one carrier element and preferably also over the rear end of the at last one carrier element.

11. The toothbrush according to claim 1, wherein the elastic material and the at least one carrier element contact one another in the front end region of the head part.

12. The toothbrush according to claim 1, wherein the at least one carrier element containing a plurality of cutouts running between the top surface and the rear surface of the carrier element; and the clusters of bristle filaments guided through the cutouts.

13. The toothbrush according to claim 12, wherein the bristle clusters can be displaced in the cutouts.

14. The toothbrush according to claim 12, wherein the cutouts are located at least partially in an elastic material of the at least one carrier element.

15. The toothbrush according to claim 12, wherein the cutouts are located at least partially in a hard plastic material of the at least one carrier element.

16. The toothbrush according to claim 1, wherein the bristle melt at least partially covering the rear surface of the at least one carrier element.

17. The toothbrush according to claim 1, wherein the carrier element is connected to the head part along an outer border of the carrier element.

18. The toothbrush according to claim 1, wherein the at least one carrier element is made of a hard plastic material and a soft plastic material.

19. The toothbrush according to claim 18, wherein the hard plastic, material is PET, acrylonitrile-butadiene-styrene, styrene-acrylonitrile, or polypropylene and the soft plastic material is a thermoplastic elastomer.

20. The toothbrush according to claim 18, wherein the Shore A hardness of the elastic material is below 70.

21. The toothbrush according to claim 1, wherein the at least one carrier element has a contact surface defined by a hard plastic material, the contact surface providing connection of the at least one carrier element with the head part.

22. The toothbrush according to claim 21, wherein the at least one carrier element is connected to the head part by the contact surface.

23. The toothbrush according to claim 1, wherein the at least one carrier element is only connected to the head part in subregions.

24. The toothbrush according to claim 1, wherein the at least one carrier element is spaced apart from the head part.

25. The toothbrush according to claim 1, wherein the at least one carrier element includes flexible cleaning elements made of an elastic material.

26. A toothbrush, comprising:

a handle part;

a head part connected to the handle part, the head part having a front face and a rear face, and the head part being made of a hard material; and at least one carrier element connected to the head part, the at least one carrier element having a top surface, a rear surface and clusters of bristle filaments having the rear end melted to form a bristle melt, wherein the head part contains an elastic material integrally moulded with the head part, and the elastic material is coordinated with the hard material to thereby form a non-releasable connection, and wherein the elastic material is supporting the bristle melt of the rear bristle ends.

27. A toothbrush, comprising:

a handle part;

a head part connected to the handle part, the head part having a front face and a rear face, and the head part being made of a hard material; and at least one carrier element connected to the head part, the at least one carrier element having a top surface, a rear surface and clusters of bristle filaments having the rear end melted to form a bristle melt, wherein the head part contains an elastic material integrally moulded with the head part, and the elastic material is coordinated with the hard material to thereby form a non-releasable connection, and wherein the elastic material is located between the rear face of the head part and the carrier element.

28. A toothbrush, comprising:

a handle part;

a head part connected to the handle part, the head part having a front face and a rear face, and the head part being made of a hard material; and at least one carrier element connected to the head part, the at least one carrier element having a top surface, a rear surface and clusters of bristle filaments having the rear end melted to form a bristle melt, wherein the head part contains an elastic material integrally moulded with the head part, and the elastic material is coordinated with the hard material to thereby form a non-releasable connection, and wherein the elastic material is located on the rear side of the head part.

29. A toothbrush, comprising:

a handle part;

a head part connected to the handle part, the head part having a front face and a rear face, and the head part being made of a hard material; and at least one carrier element connected to the head part, the at least one carrier element having a top surface, a rear surface and clusters of bristle filaments having the rear end melted to form a bristle melt, wherein the head part contains an elastic material integrally moulded with the head part, and the elastic material is coordinated with the hard material to thereby form a non-releasable connection, and wherein the bristle melt is forming separate webs.

30. A toothbrush, comprising:

a handle part;

a head part connected to the handle part, the head part having a front face and a rear face; and at least one carrier element connected to the head part, the at least one carrier element having a top surface, a rear surface and clusters of bristle filaments having the rear end melted to form a bristle melt, wherein the at least one carrier element contains an elastic material integrally moulded with the at least one carrier element, a flat elastic top surface of the carrier element being produced which deforms during use, and the carrier element comprises at least one flexible cleaning element.

31. The toothbrush according to claim 30, wherein the at least one carrier element is a two-component carrier element.

32. The toothbrush according to claim 30, wherein the at least one carrier element comprises a hard component and the elastic material.

33. The toothbrush according to claim 32, wherein the hard component is formed from sleeves having holes for accommodating the clusters of bristles.

34. The toothbrush according to claim 33, wherein sleeves are connected to one another by means of hard component webs.

35. The toothbrush according to claim 34, wherein the elastic material is provided above the webs.

36. The toothbrush according to claim 34, wherein the elastic material is provided above and beneath the webs.

37. The toothbrush according to claim 30, wherein the at least one carrier element comprises a hard component frame part having an edge of tapered configuration which serves as a welding surface.

38. The toothbrush according to claim 30, wherein the region between the sleeves is filled with the elastic material.

39. The toothbrush according to claim 30, wherein the at least one flexible cleaning element is arranged between the clusters of bristle filaments.

* * * * *